US011476578B2

(12) United States Patent
Chivukula

(10) Patent No.: US 11,476,578 B2
(45) Date of Patent: Oct. 18, 2022

(54) DUAL BAND PHASED ARRAY ANTENNA STRUCTURE AND CONFIGURATIONS THEREFOR

(71) Applicant: Honeywell International Inc., Charlotte, NC (US)

(72) Inventor: Rajesh Chivukula, Bengaluru (IN)

(73) Assignee: Honeywell International Inc., Charlotte, NC (US)

( * ) Notice: Subject to any disclaimer, the term of this patent is extended or adjusted under 35 U.S.C. 154(b) by 60 days.

(21) Appl. No.: 17/091,353

(22) Filed: Nov. 6, 2020

(65) Prior Publication Data

US 2021/0143548 A1 May 13, 2021

Related U.S. Application Data

(60) Provisional application No. 62/932,729, filed on Nov. 8, 2019.

(51) Int. Cl.

| | |
|---|---|
| ***H01Q 5/30*** | (2015.01) |
| ***H01Q 21/06*** | (2006.01) |
| ***H01Q 5/307*** | (2015.01) |
| ***H01Q 1/48*** | (2006.01) |
| *H01Q 1/32* | (2006.01) |

(52) U.S. Cl.

CPC ..... *H01Q 5/307* (2015.01); *H01Q 1/48* (2013.01); *H01Q 21/065* (2013.01); *H01Q 1/32* (2013.01)

(58) Field of Classification Search

CPC ..... H01Q 5/307; H01Q 1/48; H01Q 21/065; H01Q 1/32; H01Q 5/42; H01Q 9/045; H01Q 21/24

See application file for complete search history.

(56) References Cited

U.S. PATENT DOCUMENTS 5,043,738 A * 8/1991 Shapiro ..... H01Q 9/0435 343/700 MS
6,366,244 B1 4/2002 Fernandes
6,795,020 B2 9/2004 Sreenivas et al.
(Continued)

FOREIGN PATENT DOCUMENTS

JP 2006522550 A * 9/2006 ..... H01Q 13/10

OTHER PUBLICATIONS

Sandhu, Ali Imran et al. "Radiating Elements for Shared Aperture Tx/Rx Phased Arrays at K/Ka Band" http://hdl.handle.net/10754/605075, (14 pages).

(Continued)

*Primary Examiner* — Hoang V Nguyen
(74) *Attorney, Agent, or Firm* — Bookoff McAndrews, PLLC

(57) ABSTRACT

Disclosed is a dual band antenna with a first radiating element oriented at a first predetermined angle that operates in a first frequency band and a second radiating element oriented at a second predetermined angle that operates in a second frequency band. The dual band antenna has a ground plane that has a first slot that is associated with the first radiating element and a second slot that is associated with the second radiating element. The dual band antenna also has a first feed probe that is associated with the first radiating element and a second feed probe that is associated with the second radiating element.

20 Claims, 16 Drawing Sheets

(56) References Cited

U.S. PATENT DOCUMENTS

| | | | |
|---|---|---|---|
| 9,871,296 | B2 | 1/2018 | Foo |
| 2014/0111396 | A1 | 4/2014 | Hyjazie et al. |

OTHER PUBLICATIONS

Fayez Hyjazie et al. "Dual Band Interleaved Base Station Phased Array Antenna With Optimized Corss-Dipole and EBG/AMC Structure" Submitted May 2, 2014, https://hal.archives-ouvertes.fr/hal-00986256, (3 pages).

Qi Luo et al. "Interleaved Dual-band Circularly Polarized Active Array Antenna for Satellite Communications" School of Engineering and Digital Art, University of Kent, UK, (5 pages).

* cited by examiner

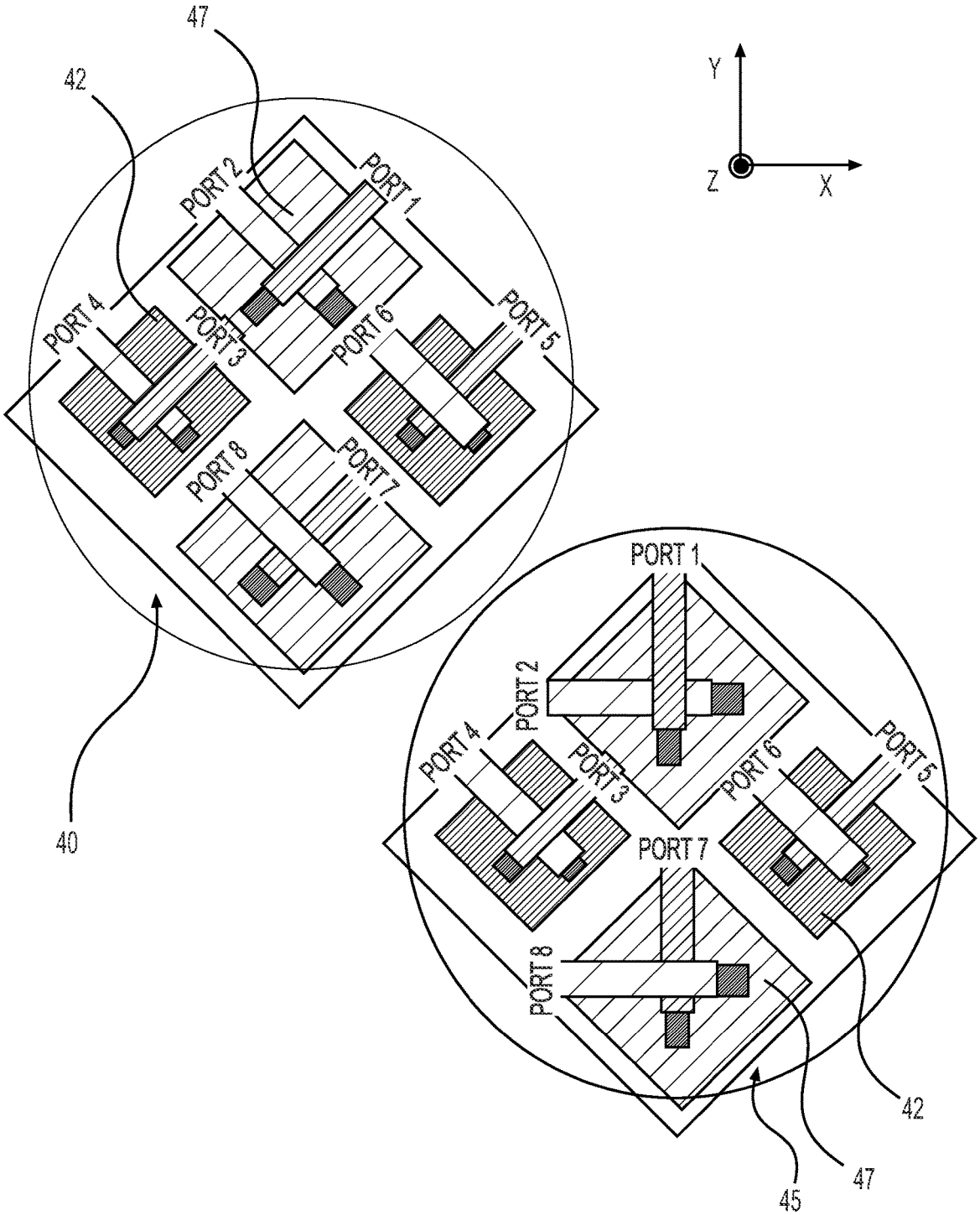
FIG. 4A PROPOSED DUAL BAND CONFIGURATION OPTIONS

PLUS-SHAPED SLOTS IN BOTH HANDS

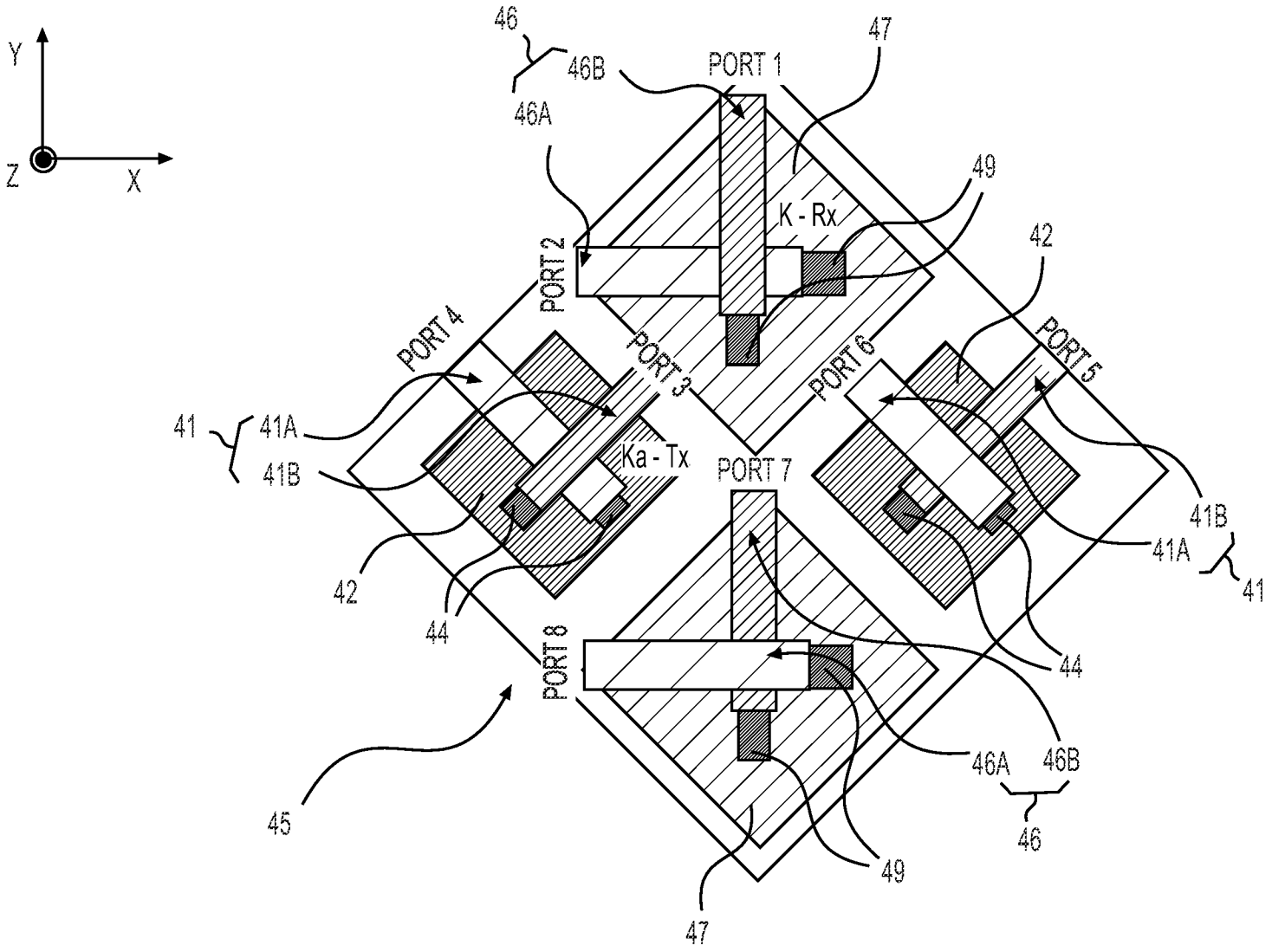
FIG. 4C CROSS-SHAPED SLOTS FOR LOWER BAND

DUAL BAND PHASED ARRAY ANTENNA STRUCTURE AND CONFIGURATIONS THEREFOR

CROSS-REFERENCE TO RELATED APPLICATION(S)

This patent application claims the benefit of priority to U.S. Provisional Patent Application No. 62/932,729, filed on Nov. 8, 2019, the entirety of which is incorporated herein by reference.

TECHNICAL FIELD

The present disclosure relates to an antenna unit cell that may be used in a variety of contexts. More particularly, the present disclosure discusses various configurations of a dual band, phased array antenna unit cell.

BACKGROUND

A moving vehicle may be equipped with multiple antennas, each operating in a frequency band dedicated to transmission and receipt of certain types of data. It may be beneficial to reduce the number and/or real estate of antennas installed in such a vehicle, in order to reduce size, weight, power and cost (SWaP-C), and reduce aerodynamic drag.

The background description provided herein is for the purpose of generally presenting the context of the disclosure. Unless otherwise indicated herein, the materials described in this section are not prior art to the claims in this application and are not admitted to be prior art, or suggestions of the prior art, by inclusion in this section.

SUMMARY OF THE DISCLOSURE

According to certain aspects of the disclosure, a dual band phased array antenna structure and configurations therefor are disclosed. In one embodiment, a dual band antenna may comprise: a first radiating element oriented at a first predetermined angle, the first radiating element operating in a first frequency band; a second radiating element oriented at a second predetermined angle, the second radiating element operating in a second frequency band; a ground plane comprising a first slot associated with the first radiating element and a second slot associated with the second radiating element; a first feed probe associated with the first radiating element; and a second feed probe associated with the second radiating element.

In another embodiment, a dual band antenna may comprise: a first array of radiating elements operating in a first frequency band and a second array of radiating elements operating in a second frequency band, wherein each radiating element of the first array of radiating elements is spaced based at least in part on the first frequency band and each radiating element of the second array of radiating elements is spaced based at least in part on the second frequency band; a ground plane comprising a first set of slots associated with the first array of radiating elements and a second set of slots associated with the second array of radiating elements, each slot of the first set of slots associated with a corresponding radiating element of the first array of radiating elements, each slot of the second set of slots associated with a corresponding radiating element of the second array of radiating elements; a first set of feed probes associated with the first array of radiating elements, each feed probe in the first set of feed probes providing energy to a corresponding radiating element of the first array of radiating elements using a slot of the first set of slots; and a second set of feed probes associated with the second array of radiating elements, each feed probe in the second set of feed probes providing energy to a corresponding radiating element of the second array of radiating elements using a slot of the first set of slots.

In yet another embodiment, a system may comprise a terminal and an antenna connected to the terminal. The antenna may comprise: a plurality of radiating elements, each radiating element of the plurality of radiating elements operating in a corresponding frequency band; a ground plane comprising a plurality of slots, each slot of the plurality of slots associated with a corresponding radiating element of the plurality of radiating elements; and a plurality of feed probes, each feed probe of the plurality of feed probes associated with a corresponding radiating element of the plurality of radiating elements.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

Embodiments of the present disclosure will now be described, by way of example only, with reference to the accompanying drawings in which:

FIG. 4A depicts different types of slot configurations available for exemplary dual band antennas discussed herein, according to one aspect of the present disclosure.

FIG. 4C depicts another one of multiple types of slot configurations available for exemplary dual band antennas discussed herein, according to one aspect of the present disclosure.

DETAILED DESCRIPTION

The following embodiments describe various configurations of a dual band, phased array antenna unit cell. In an embodiment, an antenna unit cell, may have one or more radiating elements oriented at predetermined angles. In such an embodiment, each of the radiating elements may operate in a frequency band. For example, a dual band phased array until cell may have a first radiating element oriented at a first predetermined angle and operating in a first frequency band, and a second radiating element oriented at a second predetermined angle and operating in a second frequency band. In an embodiment, the first predetermined angle and the second predetermined angle are the same.

In an embodiment, an antenna unit cell may have a ground plane where the ground plane has one or more slots, as described herein. In an embodiment, each of the one or more slots of the ground plane may be associated with a corresponding radiating element of the antenna unit cell. In the aforementioned example of a dual band phased array unit cell, the ground plane may include a first slot associated with the first radiating element and a second slot associated with the second radiating element. In an embodiment, the slots are plus-shaped as described herein. In an embodiment, the slots are cross-shaped, also as described herein.

In an embodiment, an antenna unit cell may have one or more feed probes that provide energy to the one or more radiating elements. In an embodiment, each of the one or more feed probes may provide energy to a corresponding radiating element. In the aforementioned example of dual band phased array unit cell, one or more first feed probes of the one or more feed probes may provide energy to the first radiating element, and one or more second feed probes of the one or more feed probes may provide energy to the second radiating element. It should be noted that other embodiments with other relationships between the number of radiating elements, the number and shape of the slots, and the number of feed probes that may feed energy to the radiating elements are also within the scope of the present disclosure.

Figure 1B:
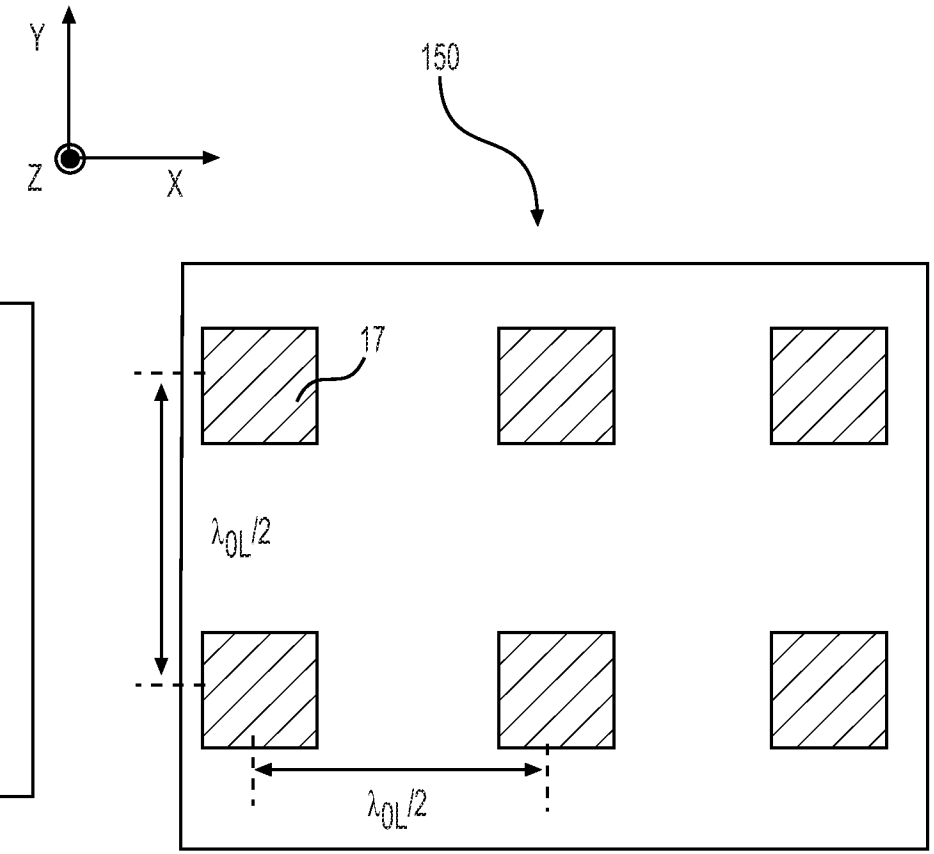
FIG. 1B shows a plan view of at least a portion of another single band antenna, operating at a lower band compared to that of the single band antenna of FIG. 1A.
Figure 1A:
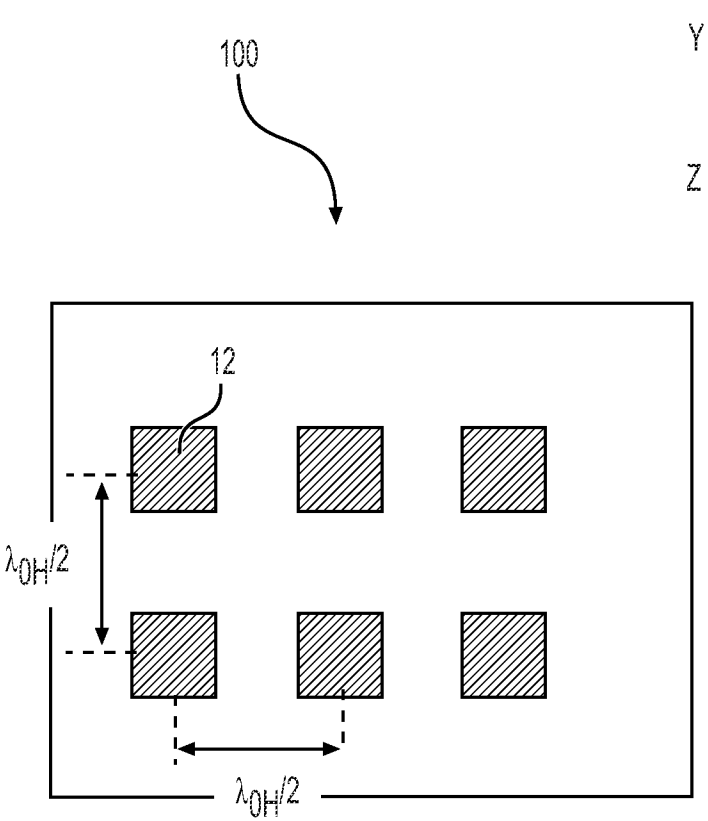
FIG. 1A shows a plan view of at least a portion of a single band antenna.

FIG. 1A shows a plan view of at least a portion of a single band antenna. Specifically, FIG. 1A illustrates an arrangement of radiating elements 12 in a single band antenna 100 operating at a higher band (i.e., higher than the single band antenna of FIG. 1B discussed below) such as, for example, Ka-band Transmit (Ka-TX) in SATCOM Applications. The general distance between the centers of two vertically or horizontally-adjacent radiating elements 12 (i.e., center-to-center distance) may be approximately half the wavelength of waves generated by the radiating elements 12 (i.e., $\lambda_{0H}/2$).

FIG. 1B shows a plan view of at least a portion of another single band antenna, operating at a lower band compared to that of the single band antenna of FIG. 1A. Specifically, FIG. 1B illustrates an arrangement of radiating elements 17 in a single band antenna 150 operating at a lower band such as, for example, K-band Receive (K-RX) in SATCOM Applications. Similar to FIG. 1A, the general distance between the centers of two vertically or horizontally-adjacent radiating elements 17 (i.e., center-to-center distance) may be approximately half the wavelength of waves generated by the radiating elements 17 (i.e., $\lambda_{0L}/2$).

Single band antennas such as those depicted in FIGS. 1A-1B may be implemented onboard a vehicle, in order for the communication system of the vehicle to transmit and receive data using multiple frequency bands. However, implementation of multiple single band apertures may take up additional space in the vehicle's limited real estate. Therefore, it may be advantageous to have a multi-band, low profile, flat panel phased array antenna to reduce the total real estate of antenna apertures onboard a vehicle, and/or to provide additional capability within the existing aperture real estate. For example, a dual band aperture may be designed to address multiple communication needs with a single terminal (e.g., a communications terminal as an element of the communications system of the vehicle that is configured to transmit data to and/or receive data from systems on and/or off the vehicle over the multiple frequency bands). Further, there is a need to have a compact and lightweight, plug-and-play type antenna to reduce installation and maintenance times.

A dual band, phased array antenna contemplated in the present disclosure may alleviate the issue discussed above and may provide the following advantages: i) greatly reduce the aperture size (e.g., up to 50% size reduction), ii) optimally use the space previously occupied by multiple, single band apertures, and ii) allow lower aerodynamic draft while providing multiband operation. The dual band, phased array antenna may be without any truncations or perforations in any of its radiating elements, thus avoiding performance degradation and achieving a wide angle scan capability with dual and/or circular polarization. The dual band antenna may comprise higher-band radiating elements and lower-band radiating elements. Each unit cell comprising the radiating elements may be rotated a predetermined angle (e.g., 45°), which may cause the radiating elements to also rotate by the predetermined angle. The rotation may allow the radiating elements to maintain $\lambda/2$ spacing between adjacent elements of both bands, thus avoiding grating lobes until the maximum scan angle (i.e., approximately 60° from the boresight). The higher-band radiating elements may be spaced at $\lambda_{0H}/2$ and the lower-band radiating elements may also be spaced at $\lambda_{0L}/2$ $\lambda_{0H}/2$. The slots feeding the radiating elements in both bands may be oriented as plus-shaped or cross-shaped slots, to enable feed probes' routing and transition to next layers.

The subject matter herein will now be described more fully hereinafter with reference to the accompanying drawings, which form a part hereof, and which show, by way of illustration, specific exemplary embodiments. An embodiment or implementation described herein as "exemplary" is not to be construed as preferred or advantageous, for example, over other embodiments or implementations; rather, it is intended to reflect or indicate that the embodiment(s) is/are "example" embodiment(s). Subject matter may be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

In the present disclosure, relative terms, such as, for example, "about," "substantially," "generally," and "approximately" are used to indicate a possible variation of ±10% in a stated value. The singular forms "a," "an," and "the" include plural reference unless the context dictates otherwise.

As discussed above, the general distance between the centers of two vertically or horizontally-adjacent radiating elements (i.e., center-to-center distance) may be approximately half the wavelength of waves generated by the radiating elements (i.e., $\lambda/2$). To implement a dual band antenna comprising an array of radiating elements operating at one frequency band (e.g., radiating elements operating at a higher band such as those depicted in FIG. 1A) and another array of radiating elements operating at another frequency (e.g., radiating elements operating at a lower band such as those depicted in FIG. 1B), spacing and orientation of such radiating elements may need to be carefully considered.

Figure 2B:
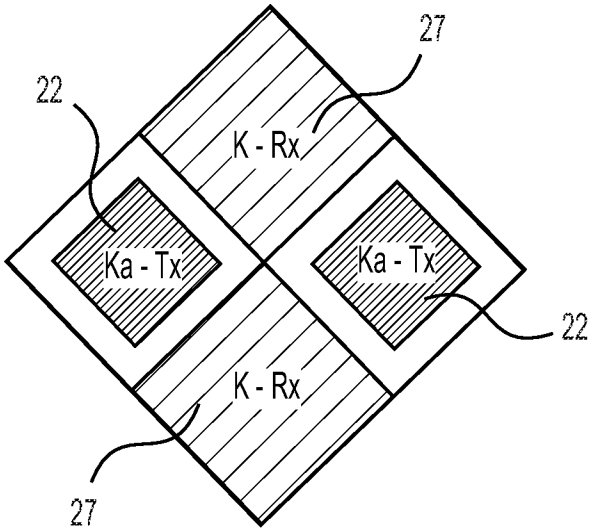
FIG. 2B shows a plan view of a unit cell of the dual band antenna of FIG. 2A, according to one aspect of the present disclosure.
Figure 2A:
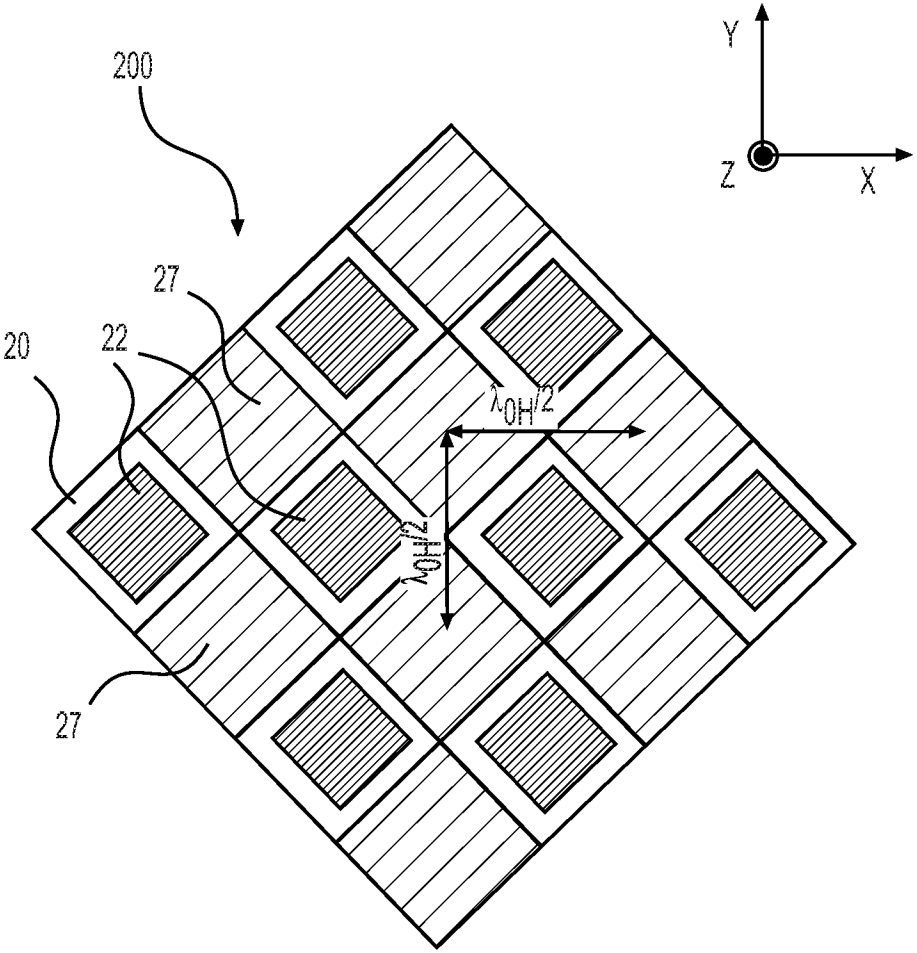
FIG. 2A shows a plan view of at least a portion of an exemplary dual band antenna, according to one aspect of the present disclosure.

Referring now to the drawings illustrative of contemplated embodiments, FIG. 2A shows a plan view of a unit cell of an exemplary dual band antenna. In general, dual band antenna 200 may comprise a first array of radiating elements 22 operating at a higher band such as, for example, Ka-band Transmit (Ka-TX) as used in SATCOM applications, interleaved with a second array of radiating elements 27 operating at a lower band such as, for example, K-band Receive (K-RX) as used in SATCOM applications. In one embodiment, the range of Ka-TX may be from approximately 29 GHz to approximately 30 GHz or 31 GHz, and the range of K-RX may be from approximately 19.7 GHz to approximately 20.2 GHz or 21.2 GHz. Thus, the frequency ratio of Ka-TX to K-RX may range approximately from 1.37 to 1.57. Each radiating element 22 of the first array may have a center-to-center distance with respect to its neighboring radiating elements of the same array (i.e., first array) less than or equal to approximately $\lambda_{0H}/2$, at the highest frequency of operation. Each radiating element 27 of the second array may have a center-to-center distance with respect to its neighboring radiating elements of the same array (i.e., second array) less than or equal to approximately $\lambda_{0H}/2$. In order to maintain the center-to-center distances and to have an adequate amount of spacing 20 between the radiating elements 22 and 27 (or spacing 20 around each radiating element 22), the radiating elements 22, 27 of the first and second arrays may be rotated a predetermined angle. For example, if a substrate or platform about which the radiating elements 22, 27 are positioned is rectangular-shaped in plan view, the radiating elements 22, 27 may be angled with respect to the sides of the substrate or platform. However, the substrate or platform may be of a different shape such as, for example, circular, oval, polygonal, triangular, etc. In one embodiment, the radiating elements 22, 27 of the first and second arrays may be rotated or angled at approximately 45°. In some embodiments, the element orientation (i.e., the degree in which the radiating elements 22, 27 may be rotated/angled) may be decided considering the feasibility of maintaining requisite element spacing for wide angle scanning up to approximately 60°. FIG. 2B shows an enlarged plan view of a pair of radiating elements 22 and 27 in the dual band antenna of FIG. 2A.

Figure 3B:
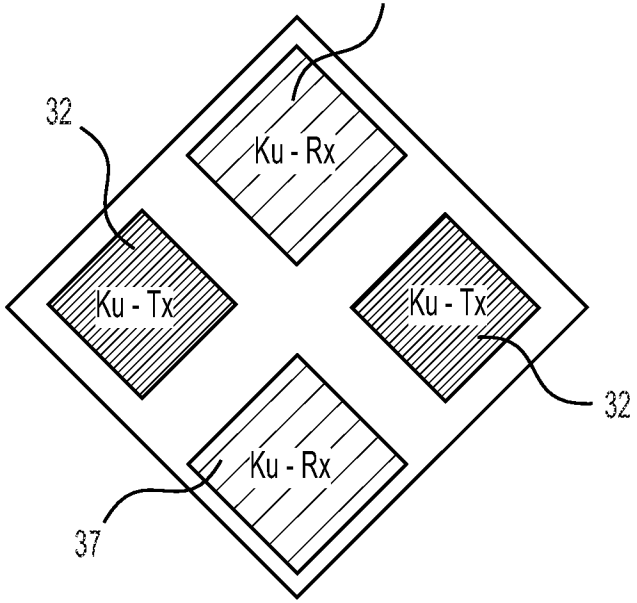
FIG. 3B shows a plan view of a unit cell of the dual band antenna of FIG. 3A, according to one aspect of the present disclosure.
Figure 3A:
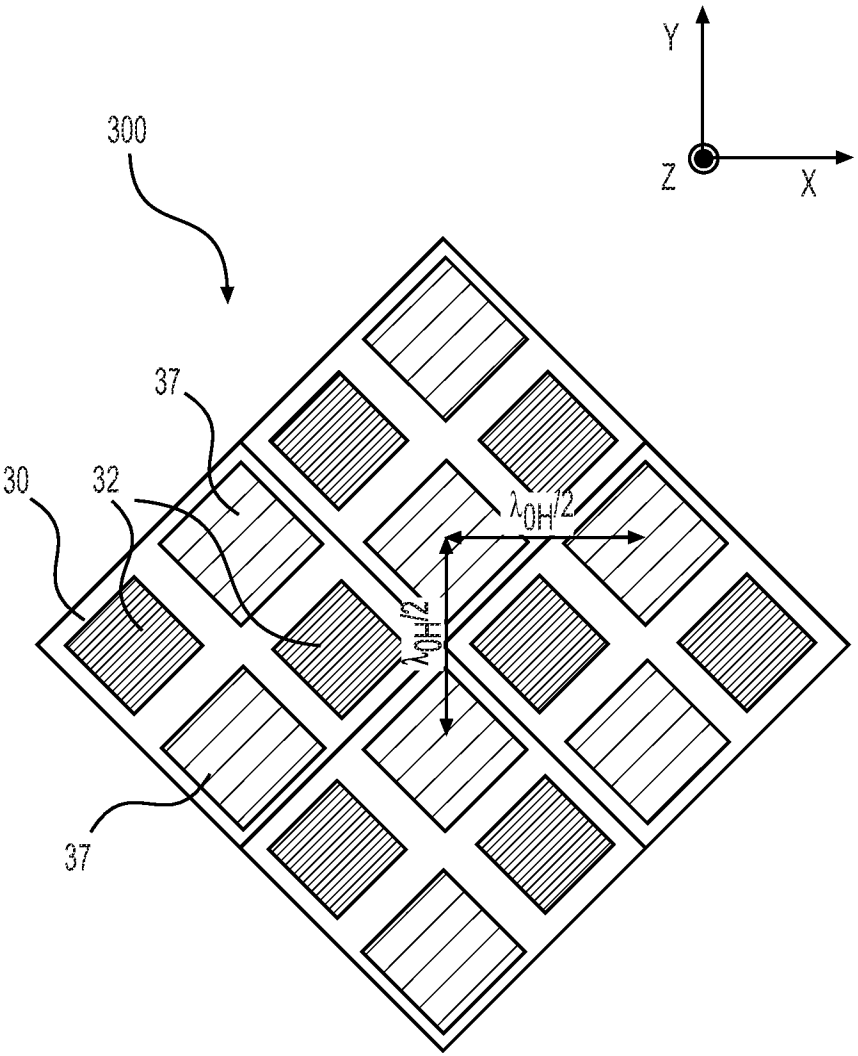
FIG. 3A shows a plan view of at least a portion of another exemplary dual band antenna, according to one aspect of the present disclosure.

FIG. 3A shows a plan view of a unit cell of another exemplary dual band antenna. In general, dual band antenna 300 may comprise a first array of radiating elements 32 operating at a higher band such as, for example, Ku-band Transmit (Ku-TX), interleaved with a second array of radiating elements 37 operating at a lower band such as, for example, Ku-band Receive (Ku-RX). In one embodiment, the range of Ku-TX may be from approximately 14 GHz to approximately 14.5 GHz, and the range of Ku-RX may be from approximately 10.7 GHz to approximately 12.75 GHz. Thus, the frequency ratio of Ku-TX to Ku-RX may range approximately from 1.1 to 1.36. The frequency ratio of the dual band antenna depicted in FIG. 3A may therefore be smaller than the frequency ratio of the dual band antenna depicted in FIG. 2A.

Similar to the dual band antenna of FIG. 2A, each radiating element 32 of the first array may have a center-to-center distance with respect to its neighboring radiating elements of the same array (i.e., first array) less than or equal to approximately $\lambda_{0H}/2$, at the highest frequency of operation. Each radiating element 37 of the second array may likewise have a center-to-center distance with respect to its neighboring radiating elements of the same array (i.e., second array) less than or equal to approximately $\lambda_{0H}/2$. Again, in order to maintain the center-to-center distances and to have an adequate amount of spacing between the radiating elements 32 and 37, the radiating elements 32, 37 of the first and second arrays may be rotated in a manner similar to that of the dual band antenna depicted in FIG. 2A. In addition, due to the smaller frequency ratio as discussed above, the spacing between the radiating elements 32 and 37 may be larger compared to the spacing between the radiating elements 22 and 27 of the dual band antenna depicted in FIG. 2A. Therefore, the dual band antenna of FIG. 3A may have a better element spacing and may thus be more plausible or easier to implement, compared to the dual band antenna of FIG. 2A. Larger spacing between radiating elements may have a number of benefits including, for example, ease of fabrication, reduced design limitations, increased routing space for feed probes, etc. FIG. 3B shows an enlarged plan view of a pair of radiating elements 32 and 37 in the dual band antenna of FIG. 3A.

It should be noted that the designs (i.e., patch designs) illustrated in FIGS. 2A-2B and 3A-3B may be implemented in dual band antennas with a frequency ratio of a higher band to a lower band being smaller than or equal to approximately 1.6. If the frequency ratio exceeds 1.6, the spacing between the radiating elements may be substantially reduced and the neighboring radiating elements may touch or overlap with each other.

As will be described further below, each radiating element may actually comprise two patches, namely a top patch and a bottom patch. Further, each radiating element and corresponding feed probes may be separated by a ground plane, and coupling between the radiating element and feed probes may be made through a slot in the ground plane. FIG. 4A depicts different types of slot configurations available for exemplary dual band antennas discussed herein. In the following sections, nomenclature used to describe the shapes of the slots (e.g., cross-shaped and plus-shaped) is with respect to the orientation of the corresponding radiating element (i.e., relative to a straight side, not a corner, of the corresponding radiating element).

Figure 4B:
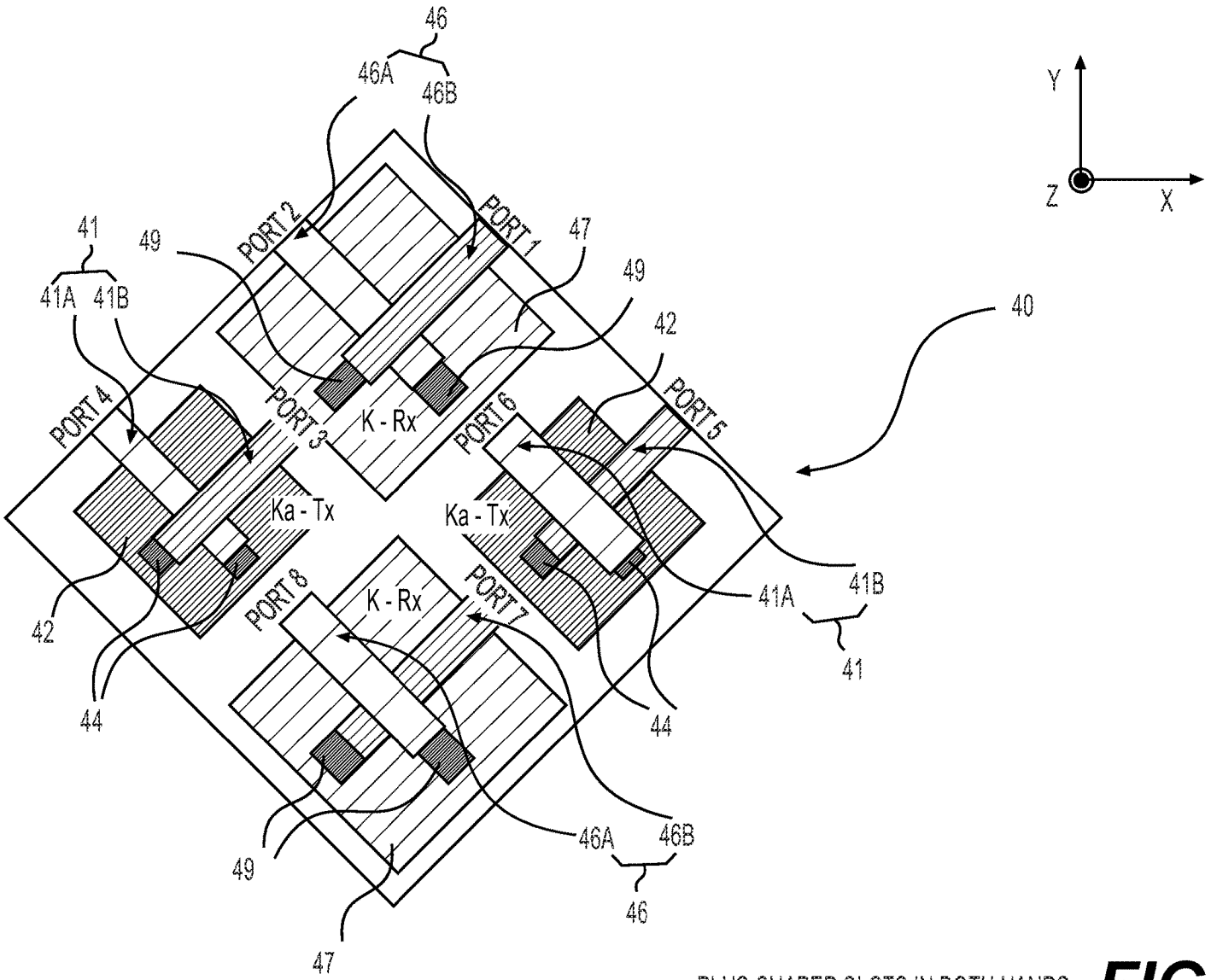
FIG. 4B depicts one of multiple types of slot configurations available for exemplary dual band antennas discussed herein, according to one aspect of the present disclosure.

As one example, configuration 40 may comprise a plus-shaped slot for each radiating element 47 (operating at a lower band) and a plus-shaped slot for each radiating element 42 (operating at a higher band). FIG. 4B shows an enlarged plan view of a pair of radiating elements 42 and 47, with corresponding slots and feed probes arranged in accordance with configuration 40. More specifically, energy may be fed to the radiating element 42 from feed probes 41A and 41B (which may together be referred to as feed probes 41), by way of slot 44 that is plus-shaped. Similarly, energy may be fed to the radiating element 47 from feed probes 46A and 46B (which may together be referred to as feed probes 46), by way of slot 49 that is plus-shaped.

Referring back to FIG. 4A, as another example, configuration 45 may comprise a cross-shaped slot for each radiating element 47 (operating at a lower band) and a plus-shaped slot for each radiating element 42 (operating at a higher band). FIG. 4C shows an enlarged plan view of a pair of radiating elements 42 and 47, with corresponding slots and feed probes arranged in accordance with configuration 45. More specifically, energy may be fed to the radiating element 42 from feed probes 41A and 41B (which may together be referred to as feed probes 41), by way of slot 44 that is plus-shaped. Similarly, energy may be fed to the radiating element 47 from feed probes 46A and 46B (which may together be referred to as feed probes 46), by way of slot 49 that is cross-shaped.

As shown in FIGS. 4B and 4C, two feed probes (e.g., a top feed probe and a bottom feed probe) may be used for each radiating element, in order to achieve dual and circular polarization. For example, a radiating element may be fed by two feed probes separated by an angle of 90° in plan view (i.e., 90° separation), with equal magnitude at the ports 1 and 2. Further, feed probes may align with slots while maintaining the 90° separation, and may be oriented in different directions depending on the spacing between and/or around radiating elements. Transmission lines such as, for example, microstrip, stripline, etc. may be used as the feed probes.

Figure 6A:
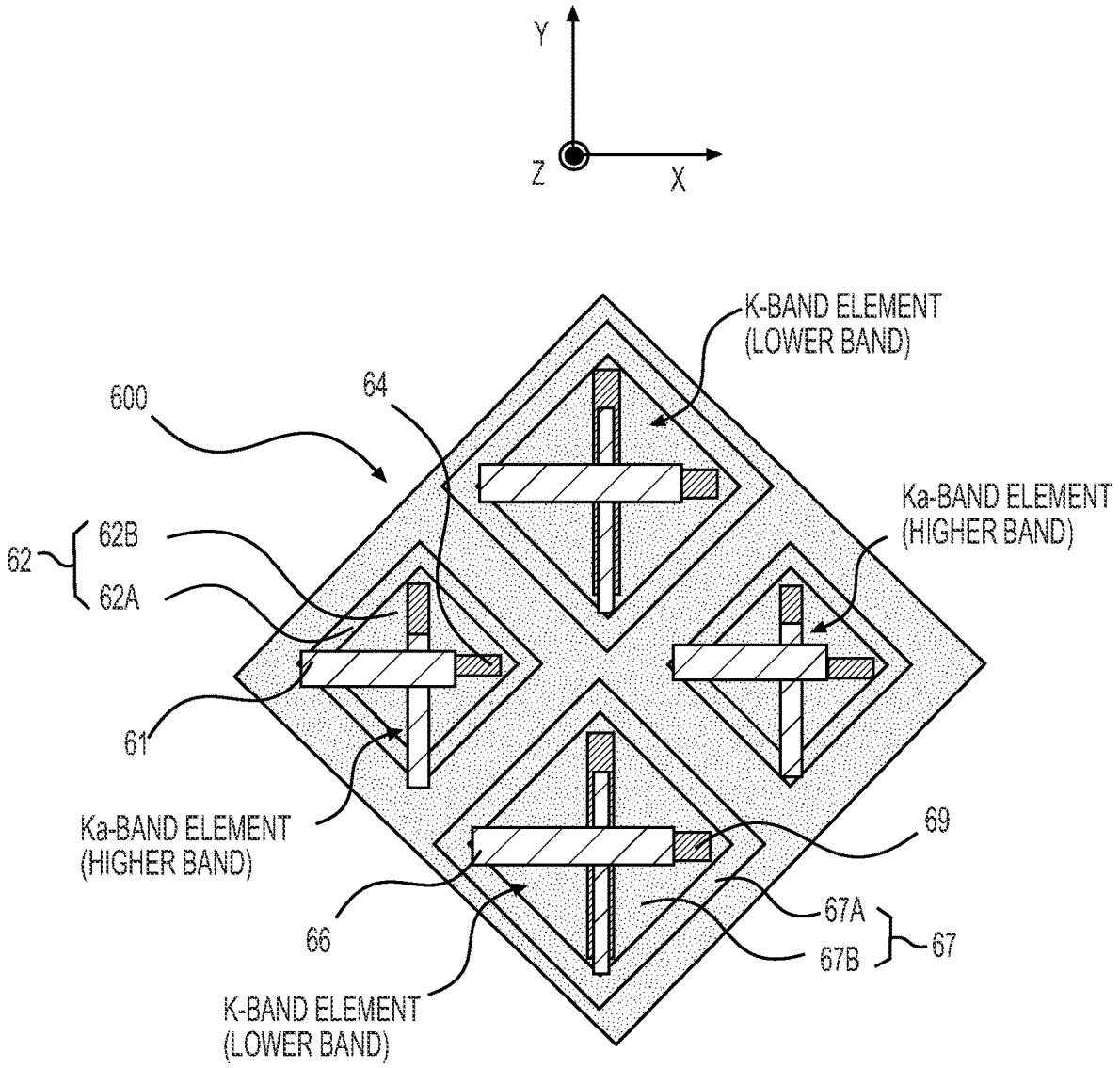
FIG. 6A shows a plan view of a unit cell of an exemplary dual band antenna with a cross-shaped slot configuration, according to one aspect of the present disclosure.

It should be noted that possible slot configurations are not limited to the configurations (e.g., configurations 40 and 45) discussed specifically herein. For instance, a plus-shaped slot may be implemented with a radiating element operating at a higher band, and a cross-shaped slot may be implemented with a radiating element operating at a lower band. Further, cross-shaped slots may be implemented with both types of radiating elements (i.e., higher band and lower band) in a dual band antenna. FIG. 6A depicts a unit cell 600 comprising radiating elements arranged in such a configuration. Specifically, both higher-band and lower-band radiating elements in unit cell 600 may implement cross-shaped slots 64 and 69 as shown in FIG. 6A. As alluded to above, each radiating element may comprise a top patch and a bottom patch. For example, a higher-band radiating element 62 may comprise a top patch 62A and a bottom patch 62B, the patches being fed by feed probes 61 aligned with a cross-shaped slot 64. A lower-band radiating element 67 may comprise a top patch 67A and a bottom patch 67B, the patches being fed by feed probes 66 aligned with a cross-shaped slot 69.

With renewed reference to FIGS. 4A-4C, although the radiating elements shown in FIGS. 4A-4C appear to be identical to the radiating elements illustrated in FIGS. 3A-3B (i.e., more similar to the radiating elements illustrated in FIGS. 3A-3B than those illustrated in FIGS. 2A-2B), the slot configurations discussed in reference to FIGS. 4A-4C may be also applicable to radiating elements operating in other bands such as, for example, the radiating elements illustrated in FIGS. 2A-2B.

Figure 6B:
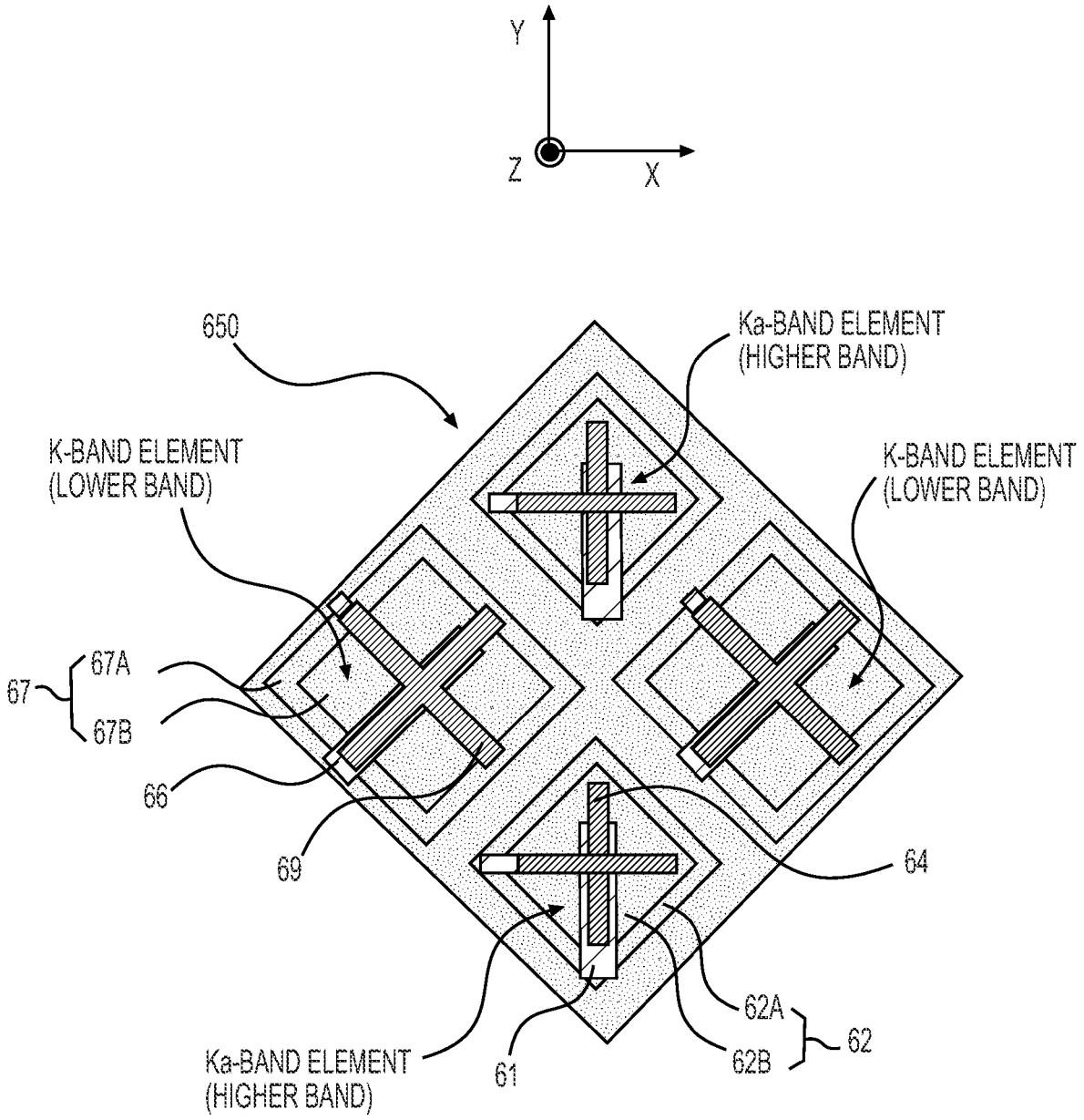
FIG. 6B shows a plan view of a unit cell of an exemplary dual band with plus and cross-shaped slot configurations, according to one aspect of the present disclosure.

Based on the foregoing, it should be apparent to a person of ordinary skill in the art that the slot configurations contemplated in the present disclosure may be applicable to different types of radiating elements in various manners. The orientation of the slots that are either plus-shaped or cross-shaped may be changed/adjusted depending on the spacing available around radiating elements. Accordingly, feed probes may also be oriented in various configurations, depending on the corresponding slot configuration and/or spacing around radiating elements. For example, FIG. 6B depicts a unit cell 650 comprising radiating elements implementing another slot configuration. However, as shown in FIG. 6B, a higher-band radiating element 62 may comprise a top patch 62A and a bottom patch 62B, the patches being fed by feed probes 61 aligned with a cross-shaped slot 64 and a lower-band radiating element 67 may comprise a top patch 67A and a bottom patch 67B, the patches being fed by feed probes 66 aligned with a plus-shaped slot 69. Further, feed probes 61 and 66 may be oriented differently from the feed probes shown in other figures.

Figure 5A:
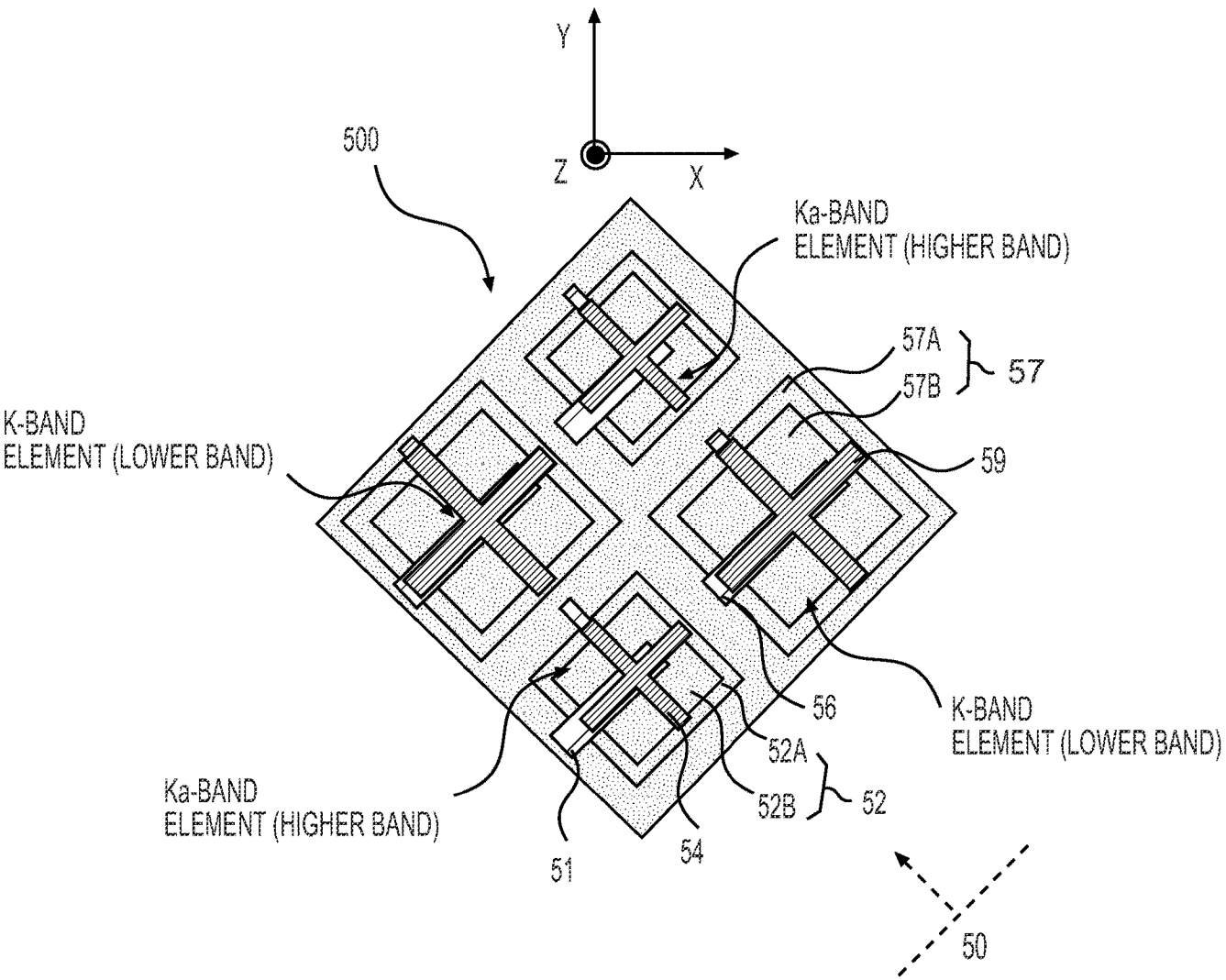
FIG. 5A shows a plan view of a unit cell of an exemplary dual band antenna with a plus-shaped slot configuration, according to one aspect of the present disclosure.
Figure 5B:
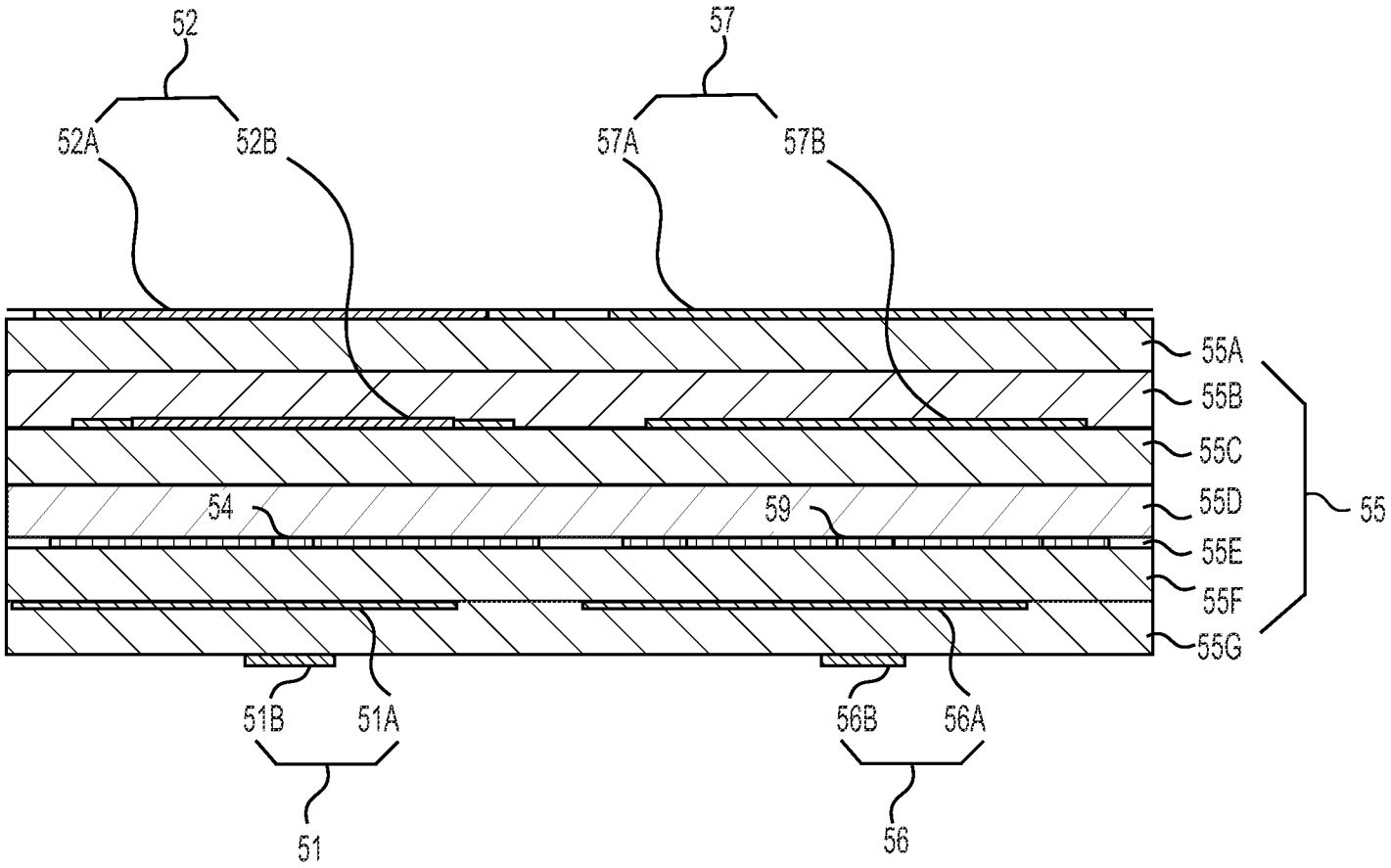
FIG. 5B shows a side view of the unit cell of FIG. 5A, according to one aspect of the present disclosure.

FIG. 5A shows a plan view of a unit cell of an exemplary dual band antenna implementing a plus-shaped slot configuration. The unit cell 500 shown in FIG. 5A has a slot configuration similar to that of radiating elements illustrated in FIG. 4B. However, as discussed above, feed probes may be oriented or rotated in different directions depending on the spacing around the radiating elements. FIG. 5A shows a feed probe orientation that is different from that of FIG. 4B. FIG. 5B depicts a side view of the unit cell 500 of FIG. 5A, viewed from a straight side of the unit cell 500 as represented by the arrow 50. Therefore, it should be understood that, although slots 54 and 59 appear to be positioned lower than the feed probes 51 and 56 in FIG. 5A, this is to better illustrate the slot configuration without obscuring the slots, and the slots 54 and 59 are actually positioned higher than the feed probes 51 and 56 (e.g., between the radiating elements 52, 57 and the feed probes 51, 56) as shown in FIG. 5B. The same rationale applies to FIGS. 5C, 6B, and 7B. In the discussion below, reference will be made to FIGS. 5A-5B.

As alluded to above, each radiating element may comprise a top patch and a bottom patch, as shown in FIG. 5A. Specifically, a higher-band radiating element 52 may comprise a top patch 52A and a bottom patch 52B, which may be fed by feed probes 51 (comprising a top feed probe 51A and a bottom feed probe 51B as shown in FIG. 5B) using slot 54. A lower-band radiating element 57 may similarly comprise a top patch 57A and 57B, which may be fed by feed probes 56 (comprising a top feed probe 56A and a bottom feed probe 56B as shown in FIG. 5B) using slot 59.

As shown in FIG. 5B, top patches 52A and 57A may be formed on and above top patch substrate 55A, which may be the top layer of multi-layer stack 55. Top patch substrate 55A may be formed of one or more dielectric materials. Bottom patches 52B and 57B may be formed on and above a bottom patch substrate 55C, which may be below and separated from the top patch substrate 55A by an air gap 55B. A spacer (not shown) may be placed between the top patch substrate 55A and the bottom patch substrate 55C in order to create the air gap 55B. Bottom patch substrate 55C may be formed of one or more dielectric materials.

Slots 59 and 54 may be etched out in ground plane 55E, through which electromagnetic coupling may occur between the feed probes and corresponding radiating elements (i.e., top patches and bottom patches). The bottom patch substrate 55C and the ground plane 55E may be separated by an air gap 55D. A spacer (not shown) may be placed between the bottom patch substrate 55C and the ground plane 55E to create the air gap 55D. Top feed substrate 55F may be formed on and below the ground plane 55E. Top feed substrate 55F may be formed of one or more dielectric materials. Top feed substrate 55F may be formed of one or more dielectric materials. Top feed probes 51A and 56A may be formed on and below the top feed substrate 55F. Bottom feed substrate 55G may be formed below the top feed substrate 55F, and may be formed over both the top feed substrate 55F and the top feed probes 51A and 56A. Bottom feed substrate 55G may be the bottom-most layer of multi-layer stack 55, and may be formed of one or more dielectric materials. Bottom feed probes 51B and 56B may be formed on and below the bottom feed substrate 55G.

Figure 5C:
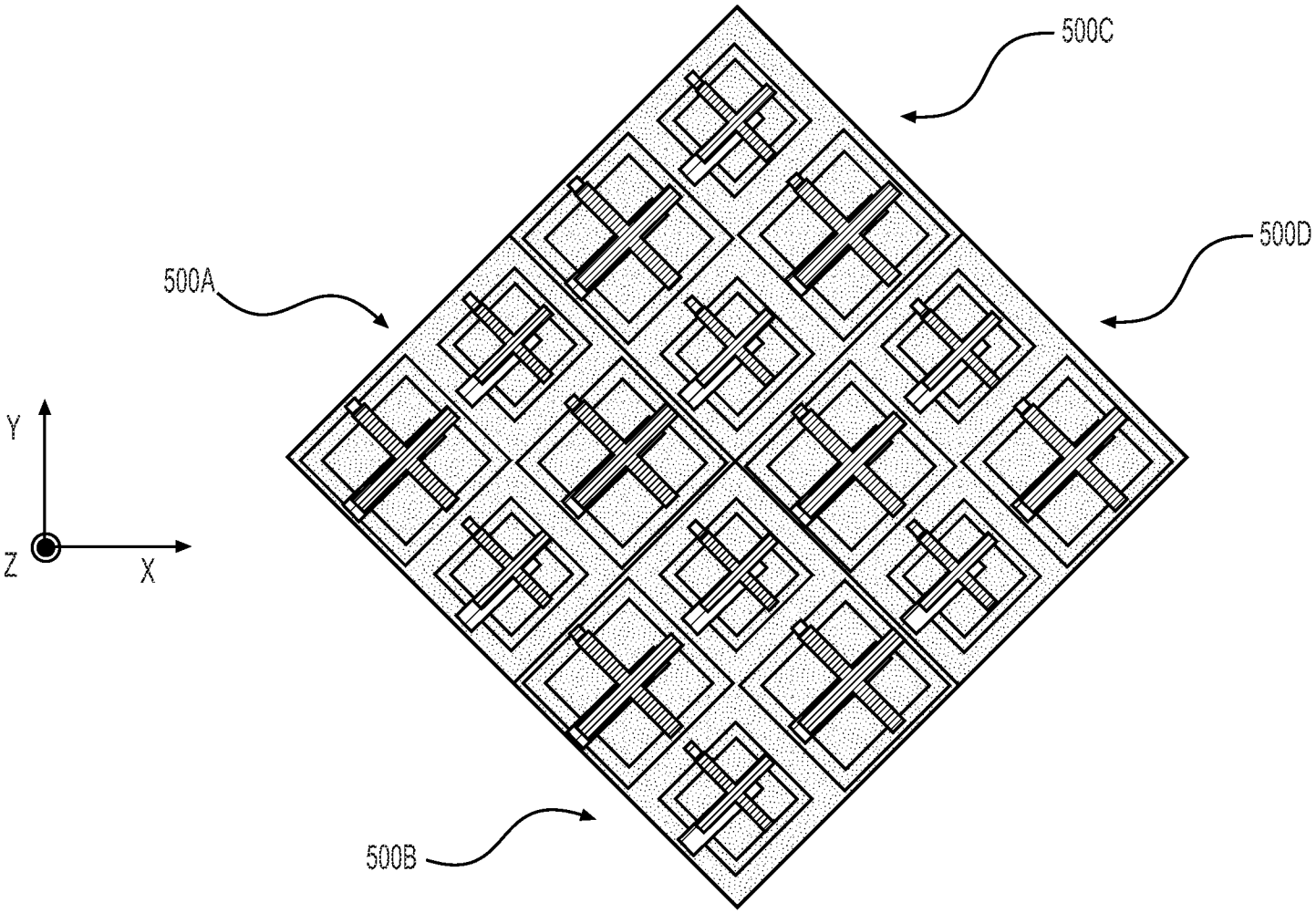
FIG. 5C shows a plan view of at least a portion of an exemplary dual band antenna comprising multiple unit cells of FIG. 5A, according to one aspect of the present disclosure.
Figure 5D:
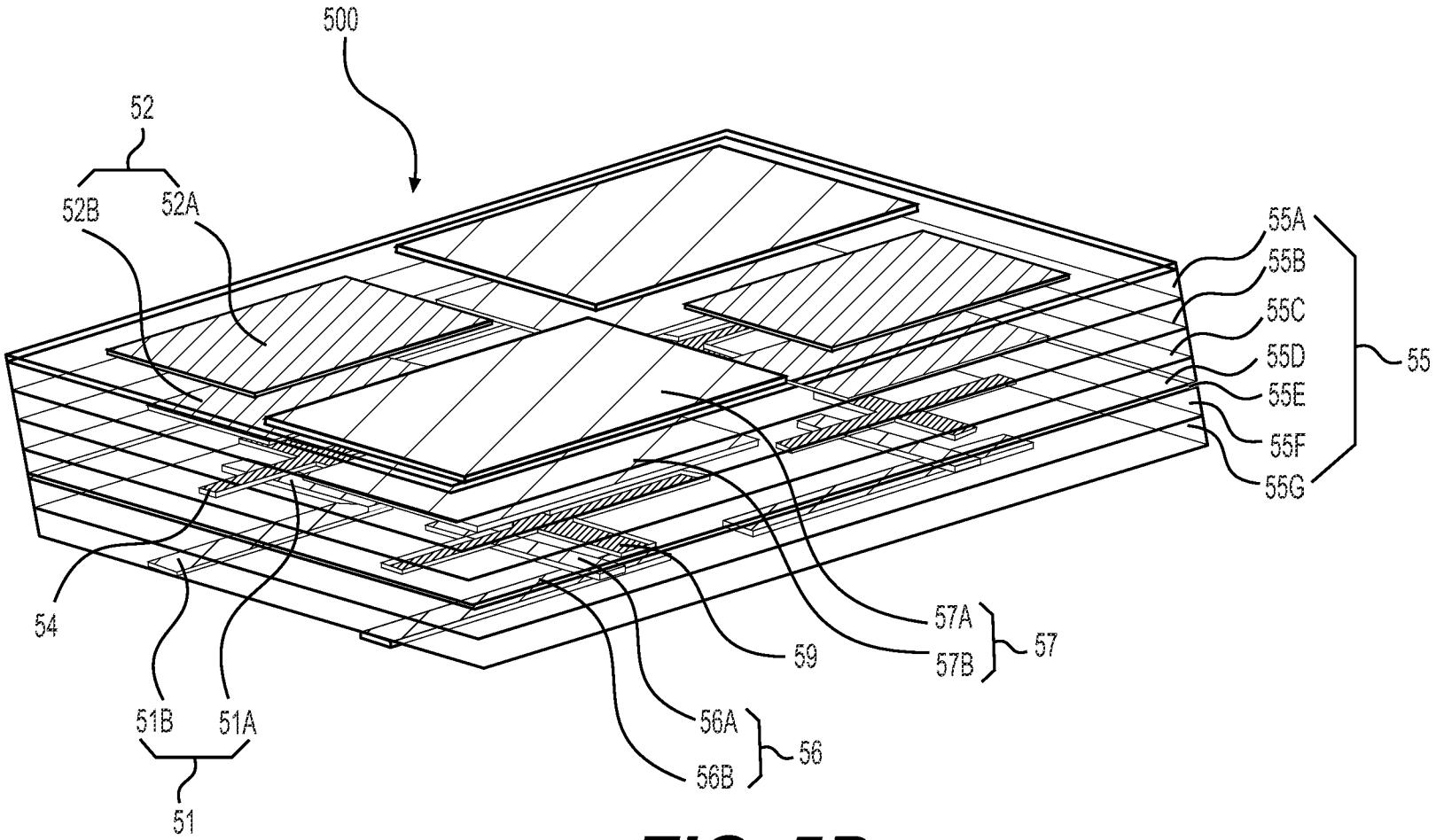
FIG. 5D shows a perspective view of the unit cell of FIG. 5A, according to one aspect of the present disclosure.

FIG. 5C shows a plan view of at least a portion of an exemplary dual band antenna comprising multiple unit cells of FIG. 5A. FIG. 5C illustrates that the aperture of the dual band antenna may be expanded by increasing the number of unit cells and cascading the unit cells across the x-y plane. For example, FIG. 5C shows unit cells 500A, 500B, 500C, and 500D cascaded across the x-y plane. FIG. 5D shows a perspective view of the unit cell 500 of FIG. 5A.

Figure 7A:
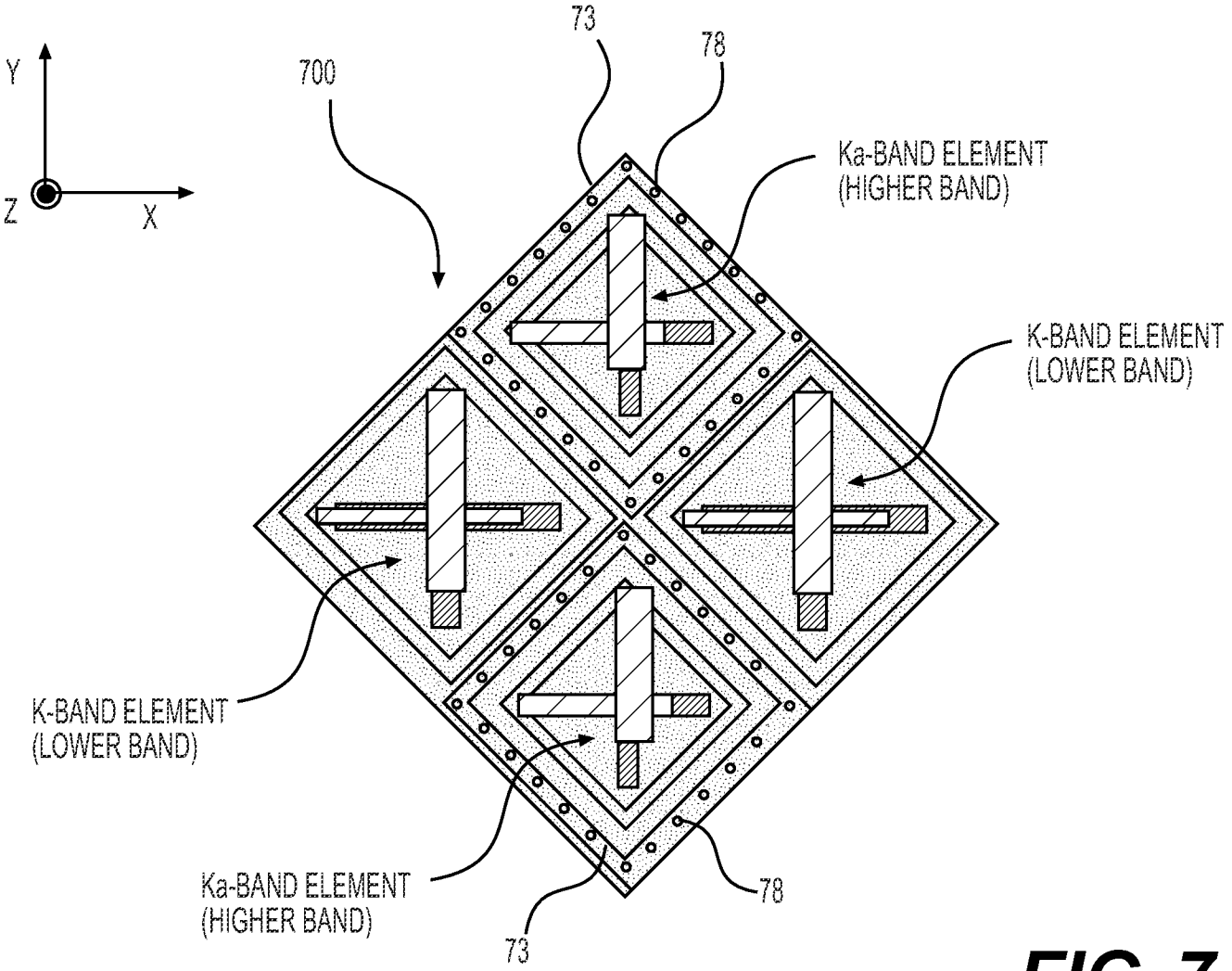
FIG. 7A depicts via cages created around radiating elements, according to one aspect of the present disclosure.
Figure 7B:
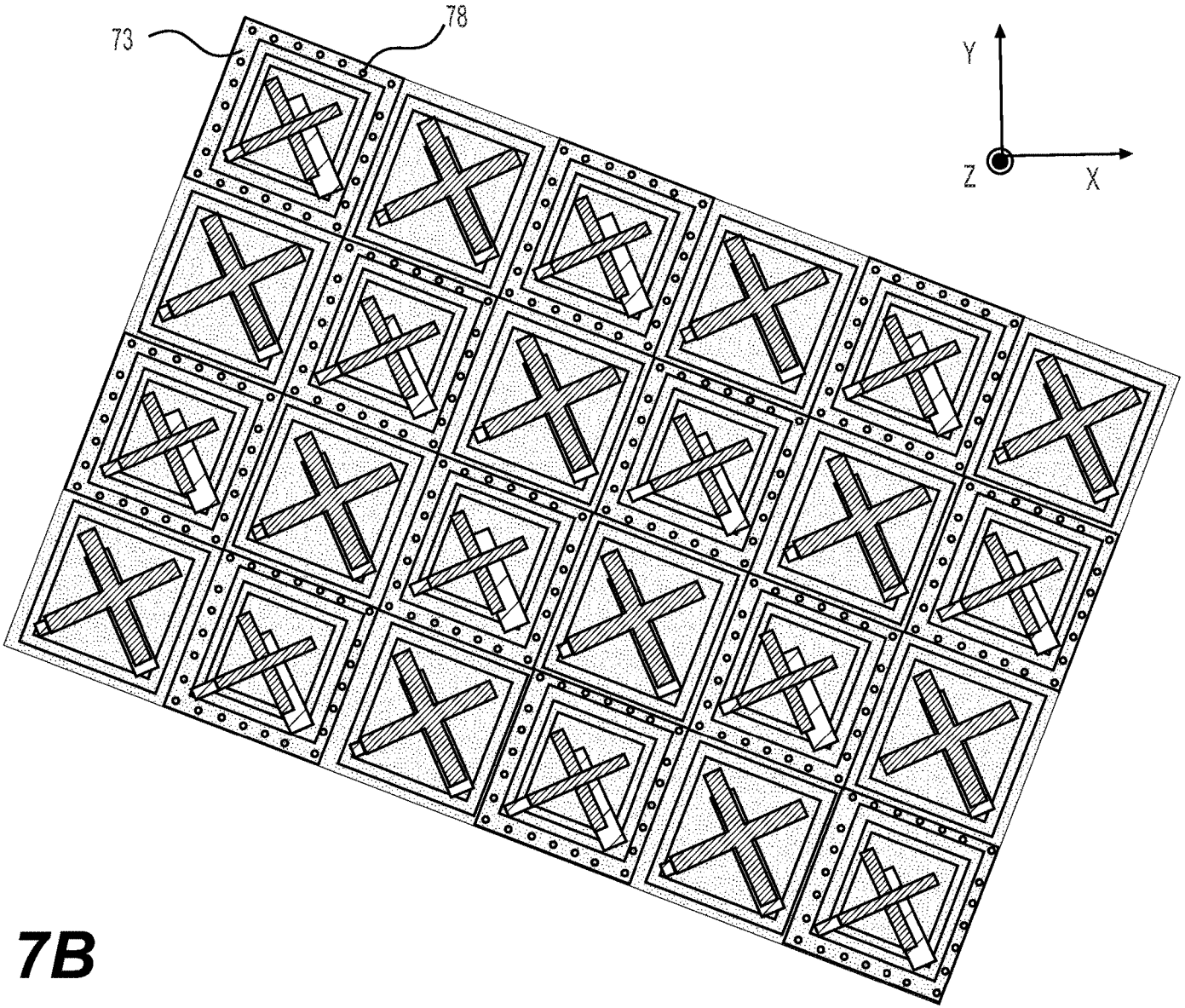
FIG. 7B shows a plan view of at least a portion of an exemplary dual band antenna implementing the via cages depicted in FIG. 7A, according to one aspect of the present disclosure.

FIG. 7A depicts via cages created around radiating elements of a unit cell. In general, a via cage 73 comprising vias 78 may be created around each higher-band radiating element, as more spacing may be available around a higher-band radiating element compared to a lower-band radiating element. As used herein, a via is an opening etched through one or more layers of a structure (e.g., a stack) and filled with an electrically conductive material, in order to form an electrical connection between the layers of the structure (e.g., in a physical electronic circuit that goes through the plane of one or more adjacent layers). A via cage is comprised of one or more such vias, as illustrated in FIGS. 7A-7D. Each side of the via cage 73 may comprise one or more vias 78, and the vias 78 may be evenly spaced around the sides of the via cage 73. In some embodiments, vias 78 may be spaced unevenly or randomly along the sides of the via cage 73. FIG. 7B shows a plan view of at least a portion of an exemplary dual band antenna implementing the via cages depicted in FIG. 7A. Specifically, FIG. 7B illustrates that the aperture of the dual band antenna may be expanded by increasing the number of unit cells 700 and cascading the unit cells 700 across the x-y plane.

Figure 7C:
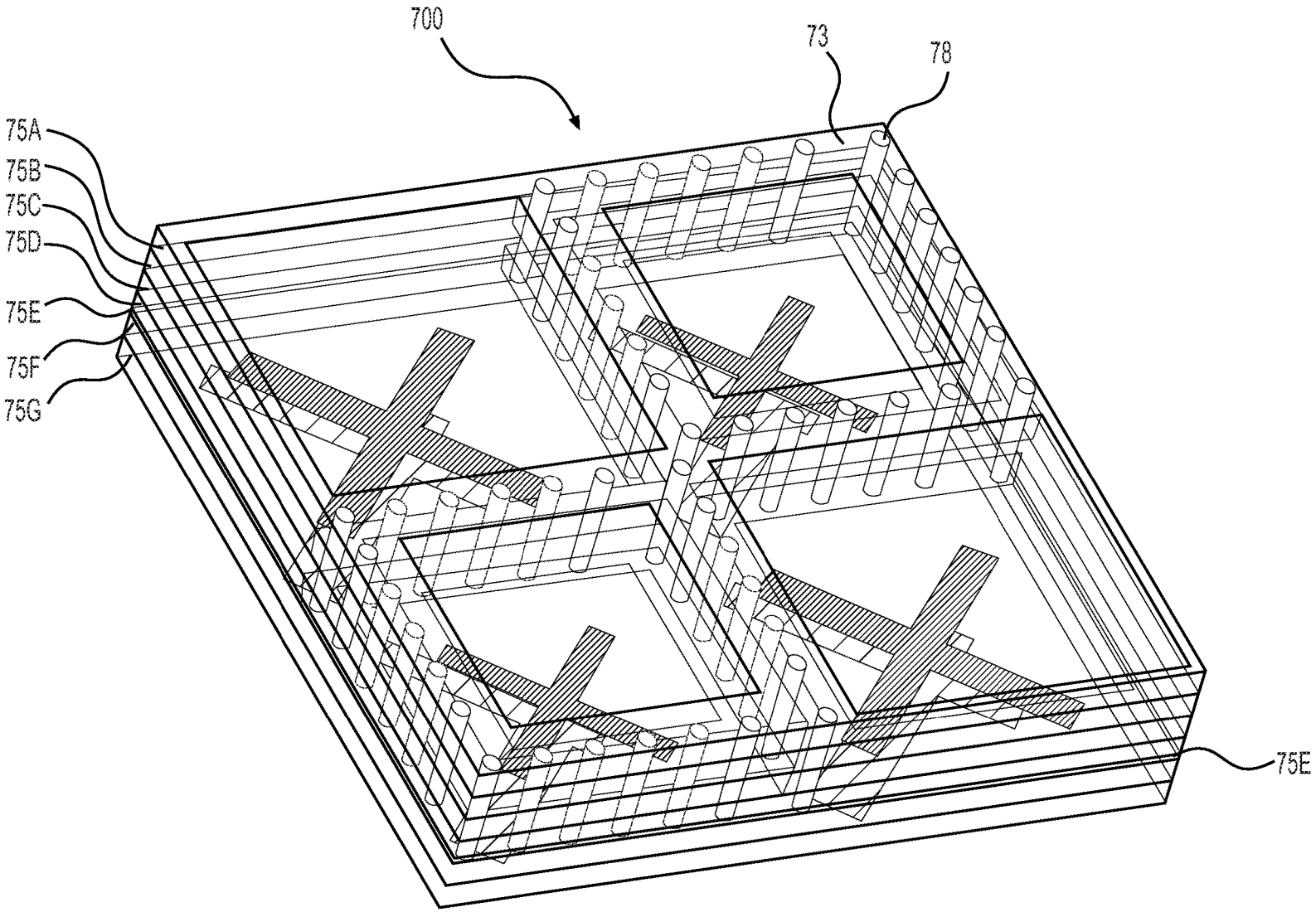
FIG. 7C shows a perspective view of the unit cell comprising the via cages depicted in FIG. 7A, according to one aspect of the present disclosure.
Figure 7D:
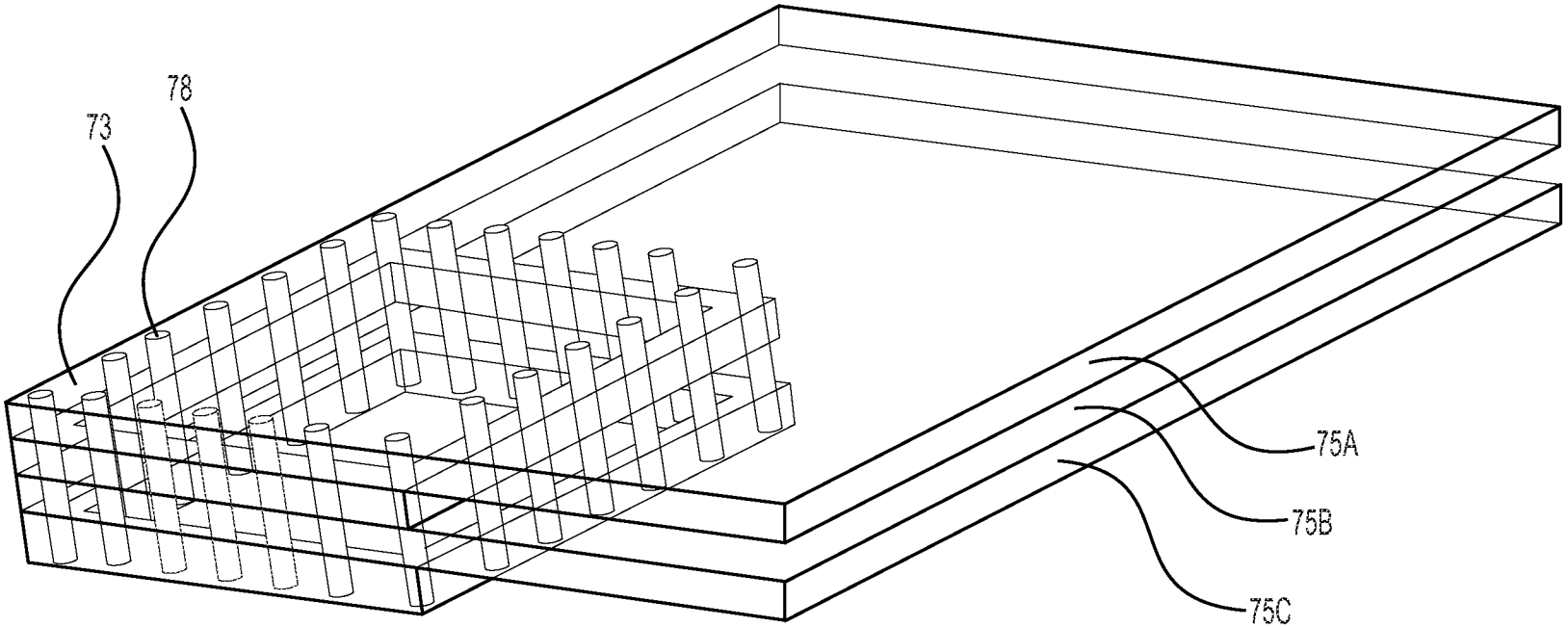
FIG. 7D shows a simplified perspective view of the via cage depicted in FIG. 7A, according to one aspect of the present disclosure.

FIG. 7C shows a perspective view of the unit cell 700 comprising the via cages 73 depicted in FIG. 7A. The via cages 73 may be created around a high-band radiating element and may extend from the top patch substrate 75A to the ground plane 75E. A printed circuit board (PCB) with a central cutout may be used to host the via cage 73 in the air gap regions 75B and 75D. The central cutout in the PCB may be left open or filled with a gap filler such as, for example, Rohacell® foam core, etc. Further, the PCB with the central cutout in air gap region 75B or 75D may be bonded to the top substrate 75A, bottom substrate 75C, and/or ground plane 75E using a prepeg process that is well-known or later-developed. Once the vias 78 are drilled and metalized (i.e., etched and filled with an electrically conductive material), ground from the top substrate 75A to the ground plane 75E may be realized. via cages 73 may be difficult to implement if the frequency ratio of the higher band to the lower band is larger than or equal to approximately 2. FIG. 7D shows a simplified perspective view of the via cage 73 depicted in FIG. 7A.

The particular embodiments disclosed above are illustrative only and should not be taken as limitations, as the embodiments may be modified and practiced in different but equivalent manners apparent to those skilled in the art having the benefit of the teachings herein. Accordingly, the foregoing description is not intended to limit the disclosure to the particular form set forth, but on the contrary, is intended to cover such alternatives, modifications, and equivalents as may be included within the spirit and scope of the proposed embodiments so that those skilled in the art should understand that they can make various changes, substitutions, and alterations without departing from the spirit and scope of the proposed embodiments in their broadest form.

Although various embodiments of the present disclosure have been illustrated and described in detail, it will be readily apparent to those skilled in the art that various modifications may be made without departing from the present disclosure or from the scope of the appended claims.

What is claimed is:

1. A dual band antenna, comprising:

a first radiating element oriented at a first predetermined angle, the first radiating element operating in a first frequency band;

a second radiating element oriented at a second predetermined angle, the second radiating element operating in a second frequency band;

a ground plane comprising a first slot associated with the first radiating element and a second slot associated with the second radiating element;

a first feed probe associated with the first radiating element, wherein the first feed probe includes a top first feed probe and a bottom first feed probe crossing the top first feed probe; and a second feed probe associated with the second radiating element, wherein the second feed probe includes a top second feed probe and a bottom second feed probe crossing the top second feed probe.

2. The dual band antenna of claim 1, wherein the first predetermined angle is the same as the second predetermined angle.

3. The dual band antenna of claim 1, wherein:

a shape of the first slot is one of plus-shaped or cross-shaped;

the shape of the first slot is based at least in part on the first frequency band;

a shape of the second slot is one of plus-shaped or cross-shaped; and the shape of the second slot is based at least in part on the second frequency band.

4. The dual band antenna of claim 1, wherein the first predetermined angle and the second predetermined angle are determined such that at least a $\lambda/2$ spacing is maintained between adjacent radiating elements of each of the first and second frequency bands.

5. The dual band antenna of claim 1, wherein the first predetermined angle and the second predetermined angle are determined based at least in part on a distance between the first radiating element and the second radiating element.

6. The dual band antenna of claim 1, wherein the first predetermined angle and the second predetermined angle are determined based at least in part on a shape of a substrate of the dual band antenna.

7. The dual band antenna of claim 1, wherein the first predetermined angle and the second predetermined angle are determined based at least in part on maintaining a spacing between the first radiating element and the second radiating element, the spacing between the first radiating element and the second radiating element based at least in part on using the dual band antenna for wide angle scanning.

8. The dual band antenna of claim 1, wherein:

the first radiating element is separated from the first feed probe by a ground plane; and the second radiating element is separated from the second feed probe by the ground plane.

9. The dual band antenna of claim 8, wherein:

a first coupling between the first radiating element and the first feed probe is made through the first slot in the ground plane; and a second coupling between the second radiating element and the second feed probe is made through the second slot in the ground plane.

10. The dual band antenna of claim 1, wherein:

energy is provided from the first feed probe to the first radiating element using the first slot; and energy is provided from the second feed probe to the second radiating element using the second slot.

11. The dual band antenna of claim 1, wherein:

the first feed probe aligns with the first slot; and the second feed probe aligns with the second slot.

12. A dual band antenna, comprising:

a first array of radiating elements operating in a first frequency band and a second array of radiating elements operating in a second frequency band, wherein each radiating element of the first array of radiating elements is spaced based at least in part on the first frequency band and each radiating element of the second array of radiating elements is spaced based at least in part on the second frequency band;

a ground plane comprising a first set of slots associated with the first array of radiating elements and a second set of slots associated with the second array of radiating elements, each slot of the first set of slots associated with a corresponding radiating element of the first array of radiating elements, each slot of the second set of slots associated with a corresponding radiating element of the second array of radiating elements;

a first set of feed probes associated with the first array of radiating elements, each feed probe in the first set of feed probes providing energy to a corresponding radiating element of the first array of radiating elements using a slot of the first set of slots, wherein each feed probe in the first set of feed probes includes a top first feed probe and a bottom first feed probe crossing the top first feed probe; and a second set of feed probes associated with the second array of radiating elements, each feed probe in the second set of feed probes providing energy to a corresponding radiating element of the second array of radiating elements using a slot of the first set of slots, wherein each feed probe in the second set of feed probes includes a top second feed probe and a bottom second feed probe crossing the top second feed probe.

13. The dual band antenna of claim 12, wherein the first array of radiating elements is interleaved with the second array of radiating elements.

14. The dual band antenna of claim 12, wherein:

each radiating element of the first array of radiating elements maintains a first center-to-center distance from an adjacent radiating element of the first array of radiating elements based at least in part on a highest frequency of the first frequency band; and each radiating element of the second array of radiating elements maintains a second center-to-center distance from an adjacent radiating element of the second array of radiating elements based at least in part on a highest frequency of the second frequency band.

15. The dual band antenna of claim 12, wherein:

each slot of the first set of slots is oriented based at least in part on spacing around each radiating element of the first radiating element array; and each slot of the second set of slots is oriented based at least in part on spacing around each radiating element of the second radiating element array.

16. The dual band antenna of claim 12, wherein:

each radiating element of the first array of radiating elements includes a corresponding first top patch and a corresponding first bottom patch; and each radiating element of the second array of radiating elements includes a corresponding second top patch and a corresponding second bottom patch.

17. The dual band antenna of claim 16, wherein:

one or more feed probes in the first set of feed probes provide energy to the each radiating element of the first array of radiating elements via the corresponding first top patch;

one or more feed probes in the first set of feed probes provide energy to the each radiating element of the first array of radiating elements via the corresponding first bottom patch;

one or more feed probes in the second set of feed probes provide energy to the each radiating element of the second array of radiating elements via the corresponding second top patch; and one or more feed probes in the second set of feed probes provide energy to the each radiating element of the second array of radiating elements via the corresponding second bottom patch.

18. A system comprising:

a terminal; and an antenna connected to the terminal, wherein the antenna comprises:

a plurality of radiating elements, each radiating element of the plurality of radiating elements operating in a corresponding frequency band;

a ground plane comprising a plurality of slots, each slot of the plurality of slots associated with a corresponding radiating element of the plurality of radiating elements; and a plurality of feed probes, each feed probe of the plurality of feed probes associated with a corresponding radiating element of the plurality of radiating elements, wherein each feed probe of the plurality of feed probes includes a top feed probe and a bottom feed probe crossing the top feed probe.

19. The system of claim 18, wherein each radiating element of the plurality of radiating elements has no truncations and no perforations.

20. The system of claim 18, wherein each feed probe of the plurality of feed probes is a transmission line.

* * * * *